United States Patent [19]

Schmidt et al.

[11] Patent Number: 4,990,007

[45] Date of Patent: Feb. 5, 1991

[54] SINGLE-RUN TYPEWRITER RIBBON CARTRIDGE HAVING A REVERSE WINDING ARRANGEMENT

[75] Inventors: Uwe Schmidt; Arthur Kittel, both of Wilhelmshaven, Fed. Rep. of Germany

[73] Assignee: AEG Olympia Aktiengesellschaft, Wilhelmshaven, Fed. Rep. of Germany

[21] Appl. No.: 213,963

[22] Filed: Jul. 1, 1988

[30] Foreign Application Priority Data

Jul. 4, 1987 [DE] Fed. Rep. of Germany ..... 3722226

[51] Int. Cl.[5] ..... B41J 32/00; B41J 33/00

[52] U.S. Cl. ..... 400/208; 400/218; 400/227

[58] Field of Search ..... 400/197, 223, 218, 225, 400/227, 227.1, 228, 230, 231, 235, 208

[56] References Cited

U.S. PATENT DOCUMENTS

| | | | |
|---|---|---|---|
| 3,665,855 | 5/1972 | Nikoloff | 400/225 |
| 3,731,781 | 5/1973 | Caudill et al. | 400/230 |
| 4,337,001 | 6/1982 | Cappotto | 400/234 |
| 4,544,291 | 10/1985 | Nagata et al. | 400/235.1 |
| 4,605,327 | 8/1986 | Ueki et al. | 400/228 |

*Primary Examiner*—Clifford D. Crowder
*Attorney, Agent, or Firm*—Spencer & Frank

[57] ABSTRACT

An ink ribbon cartridge for use in an office machine includes a housing; a ribbon; a supply reel for storing unused ribbon wound thereon and a take-up reel for storing used ribbon wound thereon, a drive roller rotatably supported in the housing; and an arrangement for resiliently urging the drive roller and the ribbon wound on the take-up reel into a peripheral, torque-transmitting contact with one another. The drive roller is arranged for being drivingly engaged by an advancing mechanism of the office machine when the cartridge is in place, whereby the drive roller imparts a rotation to the take-up reel in a winding direction for pulling the ribbon off the supply reel, for moving the ribbon through a printing station of the office machine and for winding the ribbon on the take-reel. There is further provided a reverse winding arrangement for pulling ribbon off the take-up reel and for winding the ribbon on the supply reel. The reverse winding arrangement includes a device for permitting the application of a winding torque to the supply reel; and a device for preventing blockage of the take-up reel by the drive roller in a direction opposite the winding direction.

8 Claims, 1 Drawing Sheet

SINGLE-RUN TYPEWRITER RIBBON CARTRIDGE HAVING A REVERSE WINDING ARRANGEMENT

BACKGROUND OF THE INVENTION

This invention relates to an ink ribbon cartridge for a typewriter or similar office machine and is of the type which has a housing provided with an exit opening and an entrance opening for the ribbon and is further equipped with a storage reel as well as a take-up reel on which the ribbon is wound after it has been drawn off the storage reel and has been pulled past the printing station of the machine. There is further provided a drive roller which rotates the take-up reel. When the cartridge is in place in the machine, the drive roller is torque-transmittingly coupled to a transport device forming part of the machine. Generally, the drive roller is a toothed or spiked member which peripherally engages the outermost turn of the used ribbon wound on the take-up reel. The drive roller and the used ribbon wound on the take-up reel are resiliently urged into peripheral contact with one another by spring force.

Current office machines are designed for receiving closed ink ribbon cartridges in which a portion of the ribbon extends externally of the cartridge housing between the storage reel and the take-up reel and is adapted to be received by ribbon guides of the machine. The ribbons contained in cartridges of this type are single-run (one-way) ribbons, also designated as carbon ribbons. After the single passage of the ribbon through the printing station the ribbon is used up so that a new cassette has to be inserted. It is well known that a cartridge often runs out of ribbon while a piece of work—such as a letter—is being typed. If, in such a case, no fresh ribbon cartridge is at hand, a significant time may lapse before a new cartridge is inserted for completing the interrupted work.

SUMMARY OF THE INVENTION

It is an object of the invention to provide an improved ink ribbon cartridge of the above-outlined, single-run type which makes possible a continued printing of characters with the already-used ribbon.

This object and others to become apparent as the specification progresses, are accomplished by the invention, according to which, briefly stated, the ink ribbon cartridge for use in an office machine includes a housing; a ribbon; a supply reel for storing unused ribbon wound thereon and a take-up reel for storing used ribbon wound thereon, a drive roller rotatably supported in the housing; and an arrangement for resiliently urging the drive roller and the ribbon wound on the take-up reel into a peripheral, torque-transmitting contact with one another. The drive roller is arranged for being drivingly engaged by an advancing mechanism of the office machine when the cartridge is in place, whereby the drive roller imparts a rotation to the take-up reel in a winding direction for pulling the ribbon off the supply reel, for moving the ribbon through a printing station of the office machine and for winding the ribbon on the take-up reel. There is further provided a reverse winding arrangement for pulling ribbon off the take-up reel and for winding the ribbon on the supply reel. The reverse winding arrangement includes a device for permitting the application of a winding torque to the supply reel; and a device for preventing blockage of the take-up reel by the drive roller in a direction opposite the winding direction.

The ink ribbon cartridge structured according to the invention makes possible a reverse winding of the ribbon so that, after the cartridge has run out of unused ribbon, further typing with that cartridge is feasible and thus a replacement of the ink ribbon cartridge may be delayed.

DESCRIPTION OF THE PREFERRED EMBODIMENTS

Figure 1:
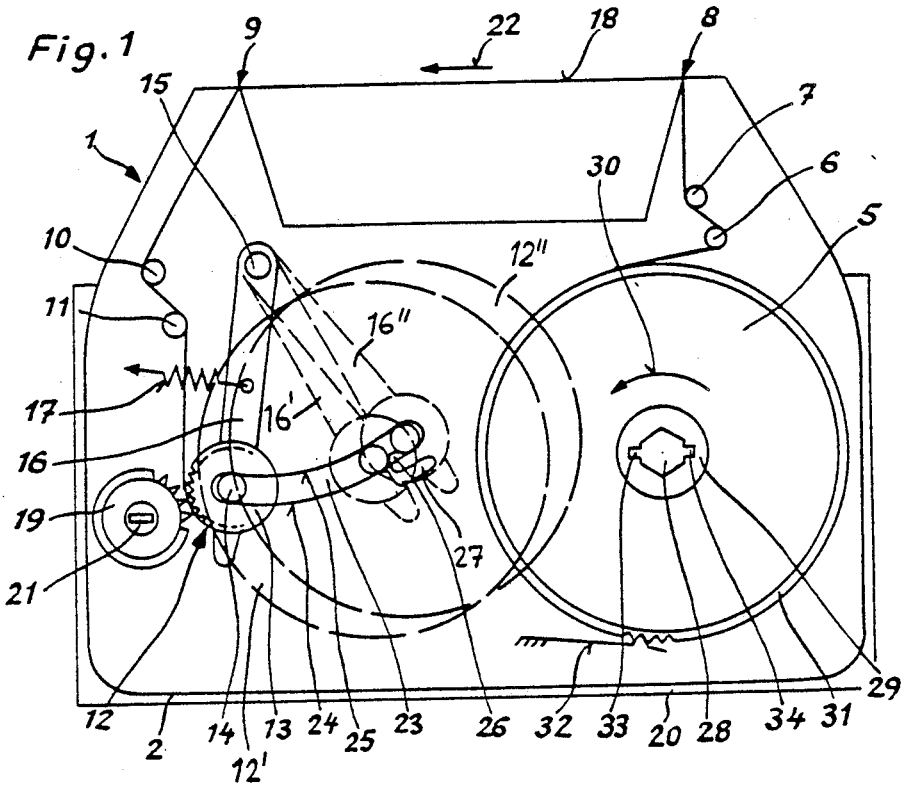
FIG. 1 is a schematic top plan view of a preferred embodiment of the invention.
Figure 2:
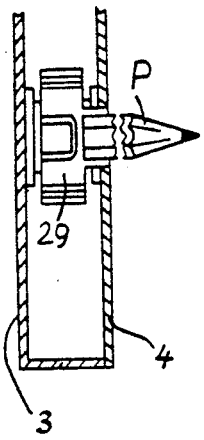
FIG. 2 is a schematic sectional side elevational view of a detail of the construction of FIG. 1.

Turning to FIGS. 1 and 2, there is shown therein an ink ribbon cartridge 1 for a typewriter or similar office machine. The cartridge 1 includes a cartridge housing 2 formed of a dish-shaped bottom part 3 and a top lid 4. A supply reel 5 is rotatably supported on the bottom 3, within the cartridge housing 2. A ribbon 18, stored on the supply reel 5, is guided out of the housing 2 by deflecting pins 6 and 7 through an outlet opening 8. From the latter the ribbon 18 passes through a printing station and then reenters the cartridge housing 2 through an entrance opening 9 provided therein and, guided by deflecting pins 10 and 11 is wound on a take-up reel 12.

The take-up reel 12 has a winding core 13 which is rotatably supported on a bearing pin 14 secured to the end of a lever 16 which, in turn, is pivotally supported on a pivot pin 15 attached to the housing bottom 3. A spring 17 attached to the pivotal lever 16 and secured to the housing bottom 3 ensures that the ribbon 18 is, at the outermost turn on the take-up reel 12, in a continuous peripheral contact with a toothed or spiked drive roller 19. The drive roller 19 is, upon positioning the cartridge in a cartridge bay 20 of the machine, torque-transmittingly connected with a knife edge-shaped advancing device 21 accommodated in the cartridge bay 20. As the ribbon 18 passes through the printing station of the office machine in the direction of the arrow 22 by virtue of it being pulled by the driving effect of the drive roller 19, the diameter of the ribbon wound on the take-up reel 12 continuously increases. As a result, the bearing pin 14 slides in an arcuate slot 23 defined by parallel spaced arcuate edges 24 and 25 of the housing lid 4. Thus, the edges 24 and 25 of the slot 23 form arcuate tracks whose center of curvature coincides with the axis of the pivot pin 15. Reference numerals 12′ and 16′ designate a substantially deflected position of the take-up reel 12 and the lever 16. For purposes to become apparent later as the specification progresses, in the lid 4 there is formed a detent lug 26 which projects into the slot 23 and which has a cutout 27 for ensuring its resilient support.

According to the invention, the ink ribbon cartridge which is, for normal operation, of the single-run (one-way) type includes an arrangement for winding ribbon onto the supply reel 5 (that is, in a reverse direction compared to the normal operation). For this purpose, a non-circular recess 28 is formed in a hub 29 of the take-up reel 5. The recess 28 is, for example, of hexagonal configuration for receiving a similarly hexagonal end portion of a pencil P or an Allen wrench.

For allowing a winding of the ribbon 18 onto the supply reel 5, the pivotal lever 16 is, with the take-up reel 12, pivoted to the far end of the guide slot 23 into a locked position 12'', 16'' in which the bearing pin 14 snaps behind the resilient detent lug 26. A shift of the lever 16 into the locked position is effected manually. For this purpose, the bearing pin 14 has an extension which projects outwardly of the cartridge housing 2 and serves for being engaged by a user's finger. It may carry an enlargement, such as an actuating knob. In such a locked position the take-up reel 12 is no longer in engagement with the drive roller 19. Thereafter, the supply reel 5 is turned in the direction of arrow 30 by means of a pencil P, an Allen wrench or the like. After such a reverse rotation, the pivotal lever 16 is shifted towards the drive roller 19, overcoming the resilient retaining force of the detent lug 26. After such a manipulation, the spring 17 again presses the ribbon wound on the take-up reel 12 against the drive roller 19. Thereafter, the normal writing process may be resumed and thus a replacement of the cartridge may be delayed. A ratchet disc 31 attached coaxially to the supply reel 5 is provided with teeth which permit a rotation of the supply reel 5 in both directions. For this purpose, a pawl 32 cooperating with the gear 31 is similarly constructed.

A reverse rotation of the supply reel 5 may also be effected, for example, by a coin or screwdriver; for this purpose, the receiving recesses 33, 34 are provided to complement the hexagonal opening 28.

Figure 3:
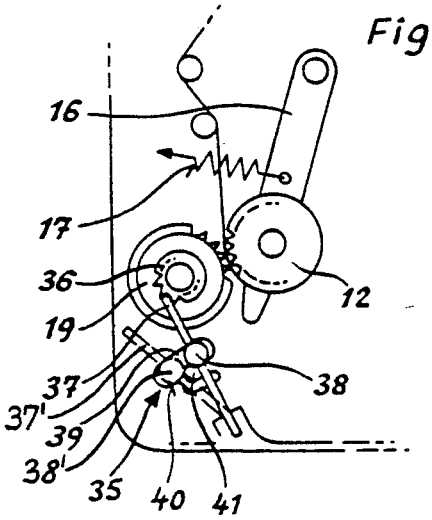
FIG. 3 is a schematic top plan view of one part of another preferred embodiment of the invention.

Turning now to FIG. 3, there is illustrated therein another preferred embodiment for the reverse winding of the ribbon. According to this embodiment, the drive roller 19 may remain in engagement with the take-up reel 12 while reverse winding onto the supply reel 5 is taking place.

With the drive roller 19 there is associated a ratchet mechanism 35 which normally permits only a rotation of the drive roller 19 in the winding direction. The ratchet mechanism comprises a ratchet wheel 36 coaxially affixed to the drive roller 19 and a pawl 37 engaging between teeth of the ratchet wheel 36.

During reverse winding (that is, winding ribbon from the take-up reel 12 onto the supply reel 5) the drive wheel 19 must be allowed to rotate freely in the reverse direction. For this purpose, the resilient locking pawl 37 may be brought into a position 37' in which it is disengaged from the ratchet wheel 36. The locking pawl 37 has a detent pin 38 which, for manual engagement, projects from the housing 2 through a slot 39. The slot 39 has a longitudinal edge 40 and a resilient detent lug 41 projecting into the path of travel of the detent pin 38. When the ribbon has been used up, that is, it is, except for a trailing terminus, fully wound on the take-up reel 12, the pawl 37 is manually brought out of engagement with the ratchet wheel 36 into the position 37', 38' behind the detent lug 41 so that the supply reel 5 can be rotated, in a manner described in connection with the embodiment shown in FIG. 1, in the direction indicated by the arrow 30. Thus, again, a desired amount of ribbon may be wound back onto the supply reel 5 to permit a prolongation of the service of the ribbon cartridge.

It will be understood that the above description of the present invention is susceptible to various modifications, changes and adaptations, and the same are intended to be comprehended within the meaning and range of equivalents of the appended claims.

What is claimed is:

1. In a single-run ink ribbon cartridge for use in an office machine; the cartridge including a housing; a ribbon; a supply reel for storing unused ribbon wound thereon and a take-up reel for storing used ribbon wound thereon; the reels being rotatably supported in said housing; said ribbon extending from said supply reel to said take-up reel and having a length portion passing externally of said housing; a sole drive roller rotatably supported in said housing; resilient means for resilient urging the drive roller and the ribbon wound on the take-up reel into a peripheral, torque-transmitting contact with one another; said drive roller being arranged for being drivingly engaged by an advancing mechanism of an office machine when the cartridge is in place thereon, whereby the drive roller applies a winding torque to the take-up reel only in a winding direction for pulling the ribbon off the supply reel, for moving the ribbon through a printing station of the office machine and for winding the ribbon on the take-up reel, and locking means normally preventing rotation of said drive roller in a direction opposite said winding direction; the improvement comprising provision to permit a prolongation of the service of said single-run ink ribbon cartridge including reverse winding means for pulling ribbon off the take-up reel and for winding the ribbon on the supply reel; said reverse winding means including (a) means for applying a winding torque to said supply reel; and (b) means for releasing said locking means to prevent blockage of said take-up reel by said drive roller while winding the ribbon on the supply reel.

2. An ink ribbon cartridge as defined in claim 1, wherein said means for preventing blockage includes (a) means for moving said take-up reel into a disengaged position in which said drive roller is out of contact with the ribbon wound on the take-up reel; and (b) detent means for immobilizing said take-up reel in said disengaged position.

3. An ink ribbon cartridge as defined in claim 2, wherein said resilient means comprises a lever pivotally supported in the housing by a pivot; the improvement further comprising a bearing pin attached to said lever and supporting said take-up reel for rotation; a spring supported in the housing and attached to said lever for urging said lever towards said drive wheel; an arcuate slot provided in said housing; said arcuate slot having a center of curvature generally coinciding with said pivot; said bearing pin being received in said slot and projecting therethrough to present a manually engageable terminus; said slot having a first end adjacent said drive roller and a second end remote from said drive roller; said bearing pin being manually shiftable to said second end of said slot whereby said take-up reel assumes said disengaged position; further wherein said detent means comprises a resiliently supported detent lug projecting into said slot and being arranged for retaining said bearing pin in said disengaged position against the force of said spring.

4. An ink ribbon cartridge as defined in claim 3, wherein said housing comprises a top lid; said arcuate slot and said detent lug being formed in said top lid; further comprising an undercut recess formed in said top lid adjacent said detent lug for providing resiliency in the support of said detent lug.

5. An ink ribbon cartridge as defined in claim 1, wherein said supply reel comprises a hub; said means for applying a winding torque comprises a non-circular opening for torque-transmittingly receiving a turning tool introduced from the outside of the cartridge for applying said winding torque.

6. An ink ribbon cartridge as defined in claim 1, wherein said releasing means comprises means for moving said locking means into an inoperative position in which said drive roller is allowed to rotate in a direction opposite said winding direction.

7. An ink ribbon cartridge as defined in claim 6, wherein said locking means includes (a) a ratchet wheel affixed to said drive roller coaxially therewith;

(b) a pawl having an operative position in which it engages between teeth of said ratchet wheel and an inoperative position in which said pawl is maintained out of engagement with said ratchet wheel; and (c) means for resiliently urging said pawl into the operative position thereof.

8. An ink ribbon cartridge as defined in claim 7, further comprising (a) a guide slot provided in said housing;

(b) a detent pin secured to said pawl and extending into said slot; said detent pin projecting outwardly from said slot and having a manually engageable terminus by means of which said pawl is shiftable into said inoperative position; and (c) a resiliently supported detent lug projecting into said slot and arranged for maintaining said pawl in said inoperative position; said detent pin and said detent lug forming part of said means for preventing blockage.

* * * * *